US007032262B2

(12) United States Patent
Creech

(10) Patent No.: US 7,032,262 B2
(45) Date of Patent: Apr. 25, 2006

(54) FITTED BEDDING

(76) Inventor: Leon K. Creech, 8117 E. Old US 33, Churubusco, IN (US) 46723

( * ) Notice: Subject to any disclaimer, the term of this patent is extended or adjusted under 35 U.S.C. 154(b) by 0 days.

(21) Appl. No.: 10/633,803

(22) Filed: Aug. 4, 2003

(65) Prior Publication Data

US 2004/0031100 A1 Feb. 19, 2004

Related U.S. Application Data

(60) Provisional application No. 60/401,177, filed on Aug. 5, 2002.

(51) Int. Cl.
*A47G 9/02* (2006.01)
*A47G 9/04* (2006.01)

(52) U.S. Cl. ..... 5/497

(58) Field of Classification Search ..... 5/497, 5/495, 482

See application file for complete search history.

(56) References Cited

U.S. PATENT DOCUMENTS 2,454,463 A * 11/1948 Kromer et al. ..... 5/497
2,598,141 A * 5/1952 Simpson ..... 5/497
2,637,049 A * 5/1953 Kromer et al. ..... 5/497
2,994,094 A * 8/1961 Hester ..... 5/497
3,694,832 A 10/1972 Jamison ..... 5/334
4,932,344 A 6/1990 Tatum ..... 112/262.1
5,029,353 A * 7/1991 Kimball et al. ..... 5/497
5,201,086 A * 4/1993 Decker et al. ..... 5/669

* cited by examiner

*Primary Examiner*—Alexander Grosz
(74) *Attorney, Agent, or Firm*—Taylor & Aust, P.C.

(57) ABSTRACT

A fitted sheet including a top rectangular fabric portion 12 having at least four edges, at least two side rectangular fabric portions including a first side rectangular fabric portion and a second side rectangular fabric portion, each of the at least two side rectangular fabric portions including a first edge, a second edge and a third edge, the first edge of the at least two side rectangular fabric portions being common with a corresponding one of the at least four edges, the second edge of the first side rectangular fabric portion being common with the second edge of the second side rectangular fabric portion and at least one triangular fabric portion including a first edge, a second edge and a third edge, the first edge of the at least one triangular fabric portion being joined to a portion of the third edge of the first rectangular fabric portion 14 and the second edge of the at least one triangular fabric portion being joined to a portion of the third edge of the second rectangular fabric portion 20. Further at least one triangular portion includes an opening configured to accommodate a hose connection to a mattress.

10 Claims, 3 Drawing Sheets

FITTED BEDDING

CROSS REFERENCE TO RELATED APPLICATIONS

This is a non-provisional application based on U.S. provisional patent application Ser. No. 60/401,177, entitled "FITTED BEDDING", filed Aug. 5, 2002.

BACKGROUND OF THE INVENTION

1. Field of the Invention

The present invention relates to bedding, and, more particularly, to fitted bedding in the form of a fitted lower sheet.

2. Description of the Related Art

Fitted bed sheets and mattress covers are well known, for example it is known for a fitted bed sheet to have an end pocket to receive an end of a mattress and hooks and eyes to secure the bottom of the pocket to the mattress. Other examples are mattress covers with elastic straps across the corners fitting underneath a mattress. And in a similar fashion mattress covers having elastic edges that fit under the mattress. Methods for production of fitted sheets are known, for example, as in U.S. Pat. No. 4,932,344 where a method and apparatus is disclosed to fabricate fitted bedding covers from a generally rectangular blank textile material, which accommodates mattress corners and allows for the application of elastic to selected portions of the cover.

U.S. Pat. No. 3,694,832 discloses a fitted bed sheet prepared from a rectangular blank of textile material including the cutting of V-shaped portions from the rectangular sheet.

Often what is done to hold a fitted mattress cover or sheet onto a bed is to utilize an elastic system or other mechanical devices to hold the bedding on the mattress. The elastic systems degrade through multiple washings. Mechanical devices break, bend and separate from sheets as they are handled and laundered.

What is needed in the art is a method to hold fitted bedding onto a mattress that is as durable as the bedding itself.

SUMMARY OF THE INVENTION

The present invention provides a fitted sheet for use in domestic and institutional settings.

The invention comprises, in one form thereof, a fitted sheet including a top rectangular fabric portion having at least four edges, at least two side rectangular fabric portions including a first side rectangular fabric portion and a second side rectangular fabric portion, each of the at least two side rectangular fabric portions including a first edge, a second edge and a third edge, the first edge of the at least two side rectangular fabric portions being common with a corresponding one of the at least four edges, the second edge of the first side rectangular fabric portion being common with the second edge of the second side rectangular fabric portion and at least one triangular fabric portion including a first edge, a second edge and a third edge, the first edge of the at least one triangular fabric portion being joined to a portion of the third edge of the first rectangular fabric portion and the second edge of the at least one triangular fabric portion being joined to a portion of the third edge of the second rectangular fabric portion.

The present invention advantageously utilizes the same fabric as a sheet to hold the sheet to the mattress.

Another advantage of the present invention is that the sheet corner inserts have a natural flexibility along a diagonal to enhance the insulation of the fitted bedding on a mattress.

Still another advantage of the present invention is that the fitted sheet will accommodate a variable height mattress utilized in institutionalized settings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
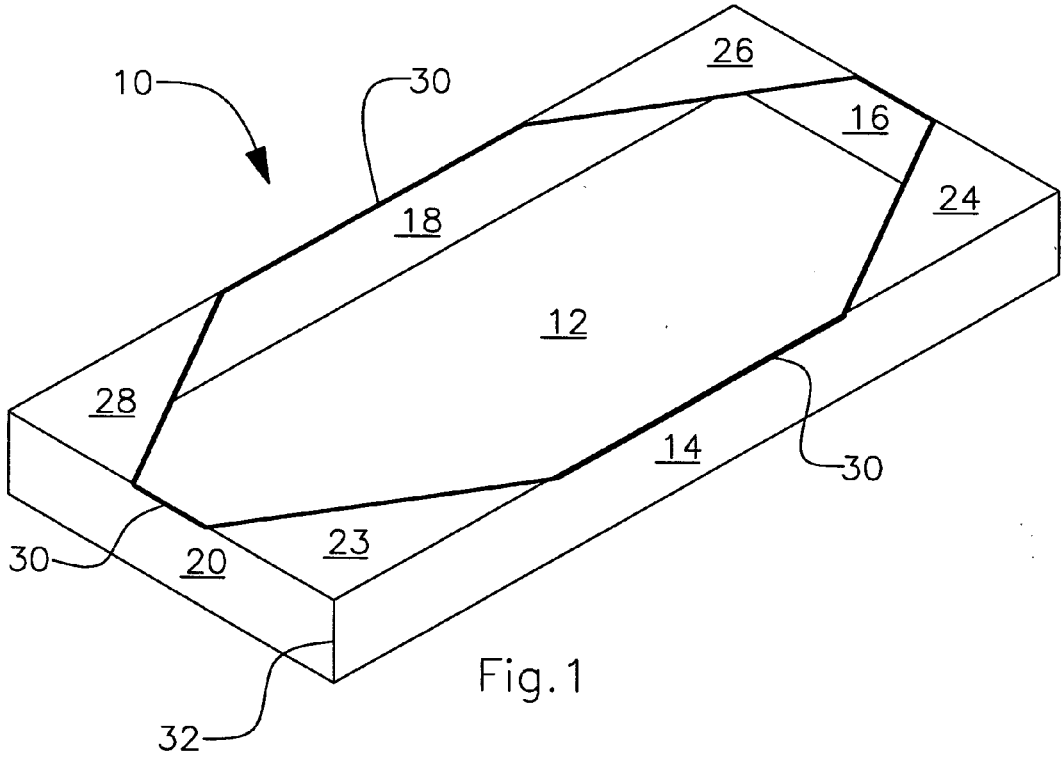
FIG. 1 is a perspective view of an embodiment of a fitted sheet shown upside down to illustrate the features of the present invention.

Referring now to the drawings, and more particularly to FIG. 1, there is shown a fitted bed sheet 10 including top portion 12, side sections 14, 16, 18 and 20, corner inserts 22, 24, 26 and 28 and turned-under edge 30. Top portion 12 and side portions 14, 16, 18 and 20 can be formed from a single piece of cloth that starts as a substantially rectangular shape. Substantially square shaped portions are removed from the corners of the rectangular cloth and corners 32 are formed by seaming the edges left after the removal of the square shaped portions. Corner inserts 22, 24, 26 and 28 are sewn to either an edge of corresponding side portion 14, 16, 18 or 20 or to an edge of turned-under portion 30. Any unseamed edge of fitted sheet 10 is appropriately hemmed.

When fitted sheet 10 is installed on a mattress, top portion 12 covers the top of the mattress and side portions 14, 16, 18 and 20 cover the sides of the mattress. Turned-under edge 30 extends a short distance under the edge of the mattress to both assist in the retaining of fitted sheet 10 of the mattress and to provide an aesthetically pleasing look. Corner inserts 22, 24, 26 and 28 advantageously retain fitted sheet 10 on the mattress.

Figure 2:
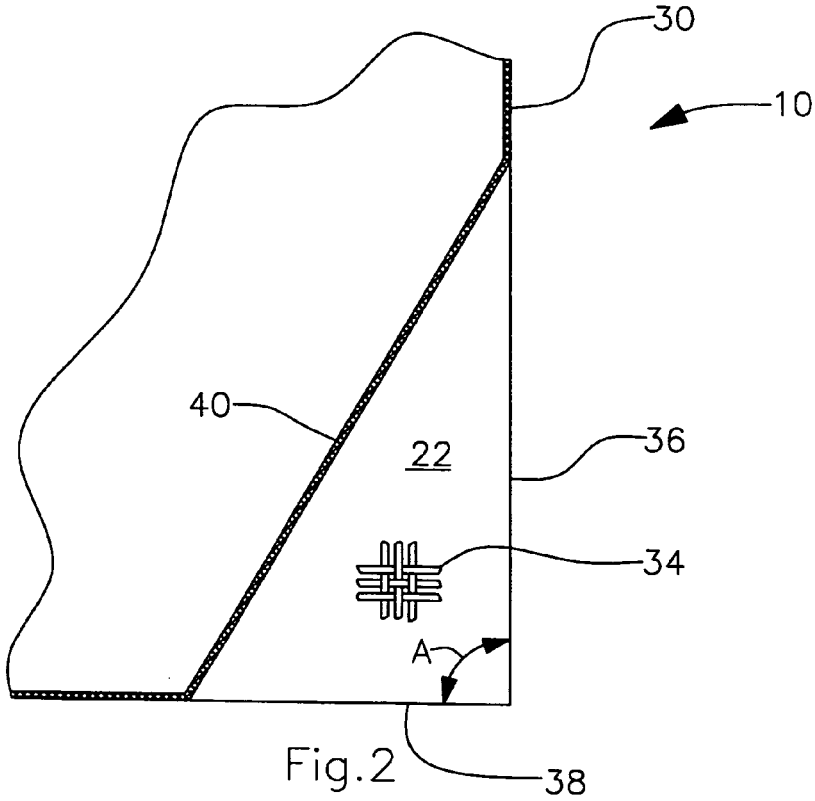
FIG. 2 is a detailed drawing of one of the corners of the fitted sheet of FIG. 1.

Now, additionally referring to FIG. 2, a corner insert such as corner insert 22 is shown as a triangular shape, which is a non-equilateral triangle having one side substantially longer than another side, which are joined at angle A. Schematically illustrated on corner insert 22 is a fiber orientation 34 which illustrates that the fibers of the fabric run generally parallel and perpendicular to the sides of fitted sheet 10.

Insert 22 has three sides 36, 38 and 40. Side 36 runs along the length of fitted sheet 10, side 38 runs along the width of fitted sheet 10 and side 40, which is a hypotenuse of the triangle, runs angularly from side 20 to side 14. Since side 40 runs at an angle and therefore cuts across the fiber orientation 34 at an angle, corner insert 22 is cut on what is described as the bias. This advantageously allows more flexing in the material thereby allowing for ease in installation and removal of fitted bedding 10. Along the edge side 40 a serge stitch is utilized to allow expansion and retraction of side 40. Angle A on corner insert 22 while shown at a 90 degree angle may vary therefrom. Angle A is selected from a range of 70 to 90 degrees to thereby alter the tension which corner insert 22 will apply to sides 14 and 20.

Figure 5:
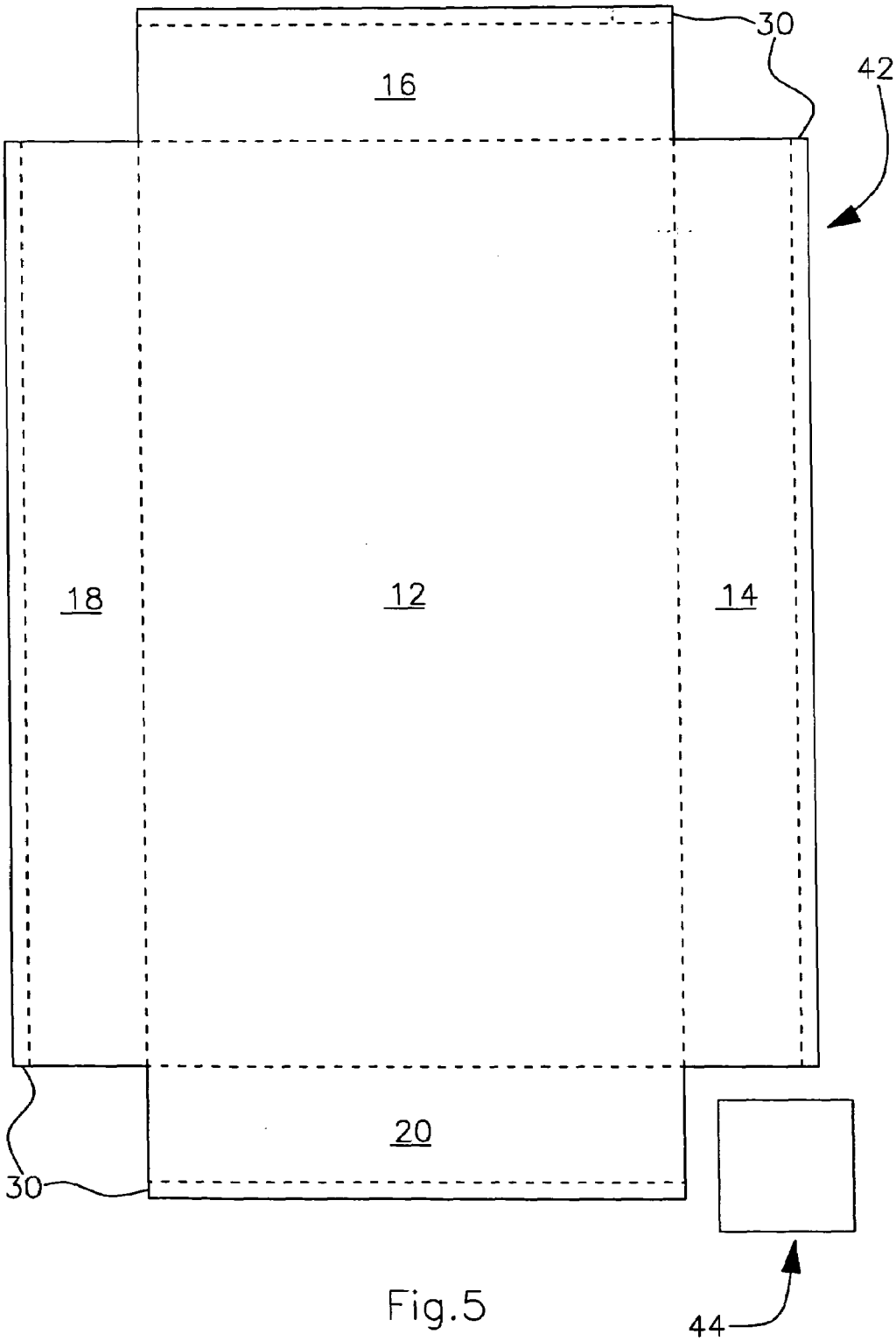
FIG. 5 is a view of a cut unseamed sheet portion of the fitted sheet of FIGS. 1 and 2.

Now, additionally referring to FIG. 5, there is shown an unstitched sheet 42 illustrating portions 12, 14, 16, 18 and 20 and turn-under portion 30, along with square 44. As stated above, top portion 12 and sides 14, 16, 18 and 20 and turned-under edge 30 can be an integral piece of cloth, which starts as a rectangle. The dimensions of the sides of the original rectangular piece of fabric are calculated using the following formulas:

Width of fabric=width of mattress+(2×height of mattress)+(2×turn-under)

Length of fabric=length of mattress+(2×height of mattress)+(2×turn-under)

The size of square corners 44 cut from the rectangular piece of fabric is calculated in the following manner:

Length of a side of square 44=height of mattress+turn-under−seam allowance where the seam allowance normally is in the range of from ¼ inch to ¾ inch.

Example: A 6 inch high mattress plus 2.5 inch turn-under 30 minus 0.5 inch seam allowance equals an 8 inch square 44 to be cut from each corner.

The length of side 38 is selected to be approximately 10 to 35 percent of the width of fabric as calculated above for the original rectangle. Preferably side 38 will be between approximately 22 and 32 percent of the width of the fabric as calculated above. In a like manner side 36 may vary between 10 and 35 percent of the length of fabric as calculated above and preferably between 22 and 32 percent of the length of fabric as calculated above. Turned-under edge 30 is normally between 1 and 4 inches for each side of the mattress and preferably between two and two and a half inches. All edges of fitted sheet 10 are finished with a hem by either serging or stitching a narrow hem. These serve as an anti-fraying type stitch along an edge that is not coupled with another piece of material.

Although corner insert 22 has been discussed at length, it is understood that the same features exist in corner inserts 24, 26 and 28. It is the sizing and shape of corner inserts 22, 24, 26 and 28 that advantageously retain fitted sheet 10 upon the mattress in a desirable way.

Figure 3:
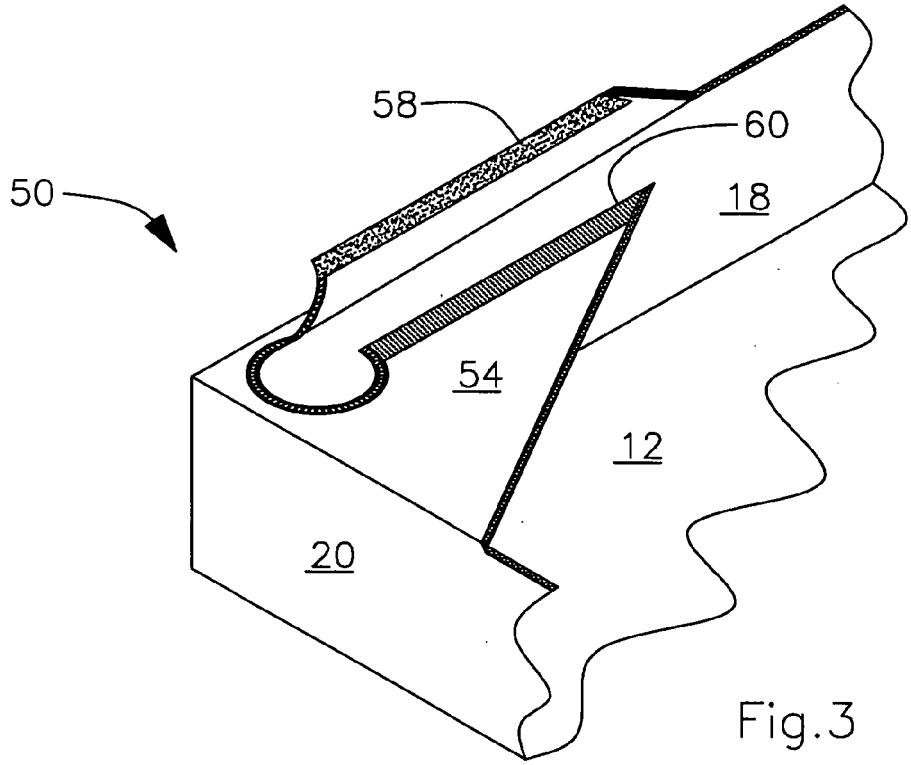
FIG. 3 is a close up view of one corner of an alternate embodiment of the present invention to accommodate an air fill tube of a mattress.
Figure 4:
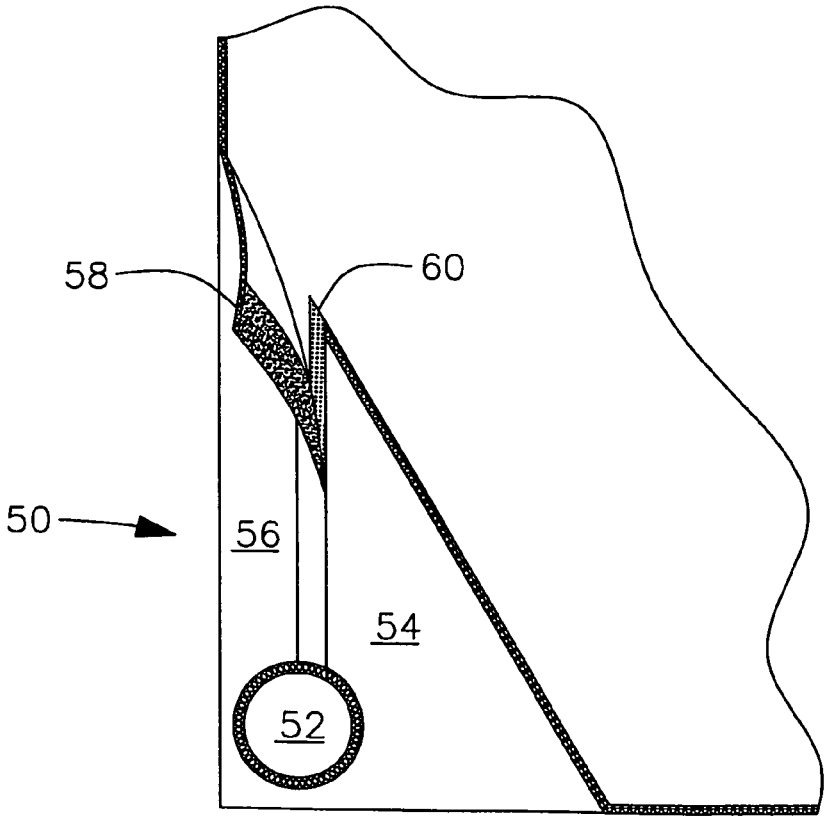
FIG. 4 is another view of the corner insert of the present invention shown in FIG. 3.

Now, additionally referring to FIGS. 3 and 4, there is shown an alternate corner insert 50 on the corner of a fitted sheet 10. Corner insert 50 includes an opening 52, a first insert portion 54, a second insert portion 56, a fastener system 58 and 60. Opening 52 is positioned to accommodate an air hose connected from an air control device (not shown) to a mattress that expands and deflates to assist a patient and to prevent the patient from getting bed sores. The calculation for obtaining the dimensions for the original rectangle, from which to manufacture fitted sheet 10, is modified to include the additional height that such a mattress obtains. Alternatively, an additionally eight to ten inches is added to the width measurements and also an additional four to ten inches to the length measurement. Both of these are multiplied by 2 since they accommodate the height of the mattress. Additionally, the extra fabric adds to the comfort of the patient. Although one corner insert can be deleted to accommodate the hose of the air mattress, the preferred solution is shown in FIGS. 3 and 4. Fastening system 58 and 60 is pulled apart to allow the insertion of the air hose (not shown). Fastening system 58 and 60 may for example be loop 58 and hook 60 of a Velcro™ system.

Advantageously the present invention utilizes the same fabric for corner inserts 22, 24, 26, 28 and 50 to provide similar life and wear characteristics as the rest of fitted sheet 10. The resiliency of inserts 22, 24, 26, 28 and 50 match the rest of fitted sheet 10 and typically do not degrade in the laundering process as portions of sheets that have rubber or synthetic elastic mechanism attached to the corners of sheets. The institutional use of fitted sheet 10 has shown the durability of this design with multiple washings resulting in a matched durability of corner inserts 22, 24, 26, 28 and 50 with the rest of the sheet.

To manufacture fitted sheet 10 a rectangular piece of fabric sized according to the above discussed formulas is selected. A square 44 from each corner of the rectangular piece of fabric is removed and the material along the edge of the removed square is joined together by a sewing operation. Corner inserts 22, 24, 26, 28 and 50, being triangular in nature, may then be produced from smaller rectangular pieces of material sized in accordance with the above-discussed dimensions. The corner inserts 22, 24, 26, 28 and 50 are then sewn in place, thereby producing fitted sheet 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fitted sheet, comprising:

a top rectangular fabric portion (12) having at least four edges;

at least two side rectangular fabric portions (14, 20) including a first side rectangular fabric portion (14) and a second side rectangular fabric portion (20), each of said at least two side rectangular fabric portions including a first edge, a second edge and a third edge, said first edge of said at least two side rectangular fabric portions being common with a corresponding one of said at least four edges, said second edge of said first side rectangular fabric portion (14) being common with said second edge of said second side rectangular fabric portion (20);

a plurality of triangular fabric portions (22, 24, 26, 28) each including a first edge, a second edge and a third edge, said plurality of triangular fabric portions (22, 24, 26, 28) including a first triangular fabric portion (22) having said first edge (36) joined to a portion of said third edge of said first rectangular fabric portion (14) and said second edge (38) of said first triangular fabric portion (22) being joined to a portion of said third edge of said second rectangular fabric portion (20), said top rectangular fabric portion (12) and said at least two side rectangular fabric portions being integral, said at least two side rectangular fabric portions are four side rectangular fabric portions additionally including a third side rectangular fabric portion and a fourth side rectangular fabric portion, said top rectangular fabric portion (12), said first side rectangular fabric portion (14), said second side rectangular fabric portion (20), said third side rectangular fabric portion (16) and said fourth side rectangular fabric portion (18) being integral and being cut from one continuous fabric, said plurality of triangular fabric portions (22, 24, 26, 28) each being a non-equilateral triangle having a corner angle between said first edge (36) and said second edge (38), one of said first edge (36) and said second edge (38) being substantially longer than the other of said first and said second edge, said corner angle being greater than approximately 70° and less than or equal to approximately 90°; and a fabric turn-under portion (30) generally running along at least a portion of one side of each of said four side rectangular fabric portions, said one continuous fabric being a rectangular piece of fabric sized according to a size of a mattress, said rectangular piece of fabric having a length and a width, said length calculated to be approximately equal to a length of said mattress plus twice a height of said mattress plus twice a width of said turn-under portion (30), said width of said rectangular piece of fabric being calculated as approximately equal to a width of said mattress plus twice a height of said mattress plus twice a width of said turn-under portion (30), said rectangular piece of fabric having a square removed from each corner, said square having a length of a side equal to said height of said mattress plus said width of said turn-under portion minus of seam allowance, said first edge (36) of said triangular fabric portion (22) having a length of between approximately 22% and approximately 32% of said width of said top rectangular piece of fabric (12), said second edge of said triangular fabric portion having a length of between approximately 22% and approximately 32% of said length of said top rectangular piece of fabric (12).

2. The fitted sheet of claim 1, wherein said third edge of said at least one triangular fabric portion is a bias cut edge finished with an anti-fraying stitch.

3. A fitted sheet for a variable thickness mattress, comprising:

a top rectangular fabric portion (12) having at least four edges;

at least two side rectangular fabric portions (14, 20) including a first side rectangular fabric portion (14) and a second side rectangular fabric portion (20), each of said at least two side rectangular fabric portions including a first edge, a second edge and a third edge, said first edge of said at least two side rectangular fabric portions being common with a corresponding one of said at least four edges, said second edge of said first side rectangular fabric portion being common with said second edge of said second side rectangular fabric portion; and at least one triangular fabric portion including a first edge (36), a second edge (38) and a third edge (40), said first edge (36) of said at least one triangular fabric portion being joined to a portion of said third edge of said first rectangular fabric portion (14) and said second edge (38) of said at least one triangular fabric portion being joined to a portion of said third edge of said second rectangular fabric portion (20), at least one said triangular fabric portion including an opening configured to accommodate a hose connection to a mattress.

4. The fitted sheet of claim 3, wherein said top rectangular fabric portion 12 and said at least two side rectangular fabric portions are integral.

5. The fitted sheet of claim 4, wherein said at least two side rectangular fabric portions are four side rectangular fabric portions additionally including a third side rectangular fabric portion and a fourth side rectangular fabric portion, said top rectangular fabric portion, said first side rectangular fabric portion, said second side rectangular fabric portion, said third side rectangular fabric portion and said fourth side rectangular fabric portion being integral and being cut from one continuous fabric.

6. The fitted sheet of claim 5, further comprising a fabric turn-under portion generally running along at least a portion of one side of each of said four side rectangular fabric portions.

7. The fitted sheet of claim 5, wherein said one continuous fabric is a rectangular piece of fabric sized according to a size of the variable thickness mattress, said rectangular piece of fabric having a length and a width, said length calculated to be approximately equal to a length of the variable thickness mattress plus twice the inflated height of the variable thickness mattress plus twice a width of said turn-under portion, said width of said rectangular piece of fabric being calculated as approximately equal to a width of the variable thickness mattress plus twice a height of the variable thickness mattress plus twice a width of said turn-under portion, said rectangular piece of fabric having a square removed from each corner, said square having a length of a side equal to said height of the variable thickness mattress plus said width of said turn-under portion minus a seam allowance.

8. The fitted sheet of claim 7, wherein said first edge of said triangular fabric portion having a length of between approximately 22% and approximately 32% of said width of said rectangular piece of fabric, said second edge of said triangular fabric portion having a length of between approximately 22% and approximately 32% of said length of said rectangular piece of fabric.

9. The fitted sheet of claim 3, wherein said third edge of said at least one triangular fabric portion is a bias cut edge finished with an anti-fraying stitch.

10. The fitted sheet of claim 3, wherein said triangular fabric portion includes a corner angle between said first edge of said triangular fabric portion and said second edge of said triangular fabric portion, said corner angle being greater than approximately 70° and less than approximately 90°.

* * * * *